US009249507B2

(12) United States Patent
Hsu et al.

(10) Patent No.: US 9,249,507 B2
(45) Date of Patent: Feb. 2, 2016

(54) CHEMICAL BATH DEPOSITION (CBD) APPARATUS

(75) Inventors: Wei-Tse Hsu, Taoyuan County (TW); Tung-Po Hsieh, Taipei (TW); Song-Yeu Tsai, Taipei (TW)

(73) Assignee: Industrial Technology Research Institute, Hsinchu (TW)

( * ) Notice: Subject to any disclaimer, the term of this patent is extended or adjusted under 35 U.S.C. 154(b) by 571 days.

(21) Appl. No.: 13/452,933

(22) Filed: Apr. 23, 2012

(65) Prior Publication Data

US 2013/0152856 A1 Jun. 20, 2013

(30) Foreign Application Priority Data

Dec. 14, 2011 (TW) ..... 100146215 A

(51) Int. Cl.

| | |
|---|---|
| ***B05C 3/02*** | (2006.01) |
| ***B05C 3/04*** | (2006.01) |
| ***B05B 1/00*** | (2006.01) |
| ***C23C 18/12*** | (2006.01) |

(52) U.S. Cl.

CPC . *C23C 18/12* (2013.01); *B05C 3/02* (2013.01); *C23C 18/1204* (2013.01); *C23C 18/125* (2013.01); *C23C 18/1283* (2013.01); *C23C 18/1295* (2013.01)

(58) Field of Classification Search

None

See application file for complete search history.

(56) References Cited

U.S. PATENT DOCUMENTS

| | | | |
|---|---|---|---|
| 4,335,266 | A | 6/1982 | Mickelsen et al. |
| 7,541,067 | B2 | 6/2009 | Basol |
| 7,645,491 | B2 | 1/2010 | Bush et al. |
| 7,885,547 | B2 | 2/2011 | Nakaso et al. |
| 2002/0182338 | A1 | 12/2002 | Stevens et al. |
| 2007/0122564 | A1 | 5/2007 | Cheng et al. |
| 2008/0299411 | A1 | 12/2008 | Oladeji |
| 2009/0223444 | A1 | 9/2009 | Basol |
| 2009/0246908 | A1 | 10/2009 | Basol et al. |
| 2009/0255461 | A1 | 10/2009 | Basol |
| 2011/0021007 | A1 | 1/2011 | de Rochemont et al. |
| 2011/0027938 | A1 | 2/2011 | Ahn |
| 2011/0039366 | A1* | 2/2011 | Basol et al. ..... 438/62 |
| 2011/0256656 | A1 | 10/2011 | Wang |

FOREIGN PATENT DOCUMENTS

| | | |
|---|---|---|
| CN | 1572911 | 2/2005 |
| CN | 1900358 | 1/2007 |
| CN | 201367462 | 12/2009 |

(Continued)

OTHER PUBLICATIONS

Gutiérrez-Lazos et al., "Multiple dip deposition of CdS films prepared by oscillating chemical bath," Thin Solid Films 518, 2010, pp. 5387-5390.

(Continued)

*Primary Examiner* — Dah-Wei D Yuan
*Assistant Examiner* — Jethro M Pence
(74) *Attorney, Agent, or Firm* — Jianq Chyun IP Office

(57) ABSTRACT

A chemical bath deposition (CBD) apparatus includes a first cap, a second cap, and a solution input/output device. The second cap is arranged corresponding to the first cap so as to form a deposition space. The solution input/output device is located in the first cap so as to feed a solution into/out of the deposition space. The position of the solution input/output device is fixed, or the solution input/output device is movable in the deposition space.

20 Claims, 10 Drawing Sheets

(56) References Cited

FOREIGN PATENT DOCUMENTS

| | | | | |
|---|---|---|---|---|
| CN | 201567373 | | 9/2010 | |
| TW | M358403 | | 6/2009 | |
| TW | 201128791 | * | 8/2011 | ..... H01L 31/18 |
| WO | 2009075944 | | 6/2009 | |
| WO | 2009/111055 | | 9/2009 | |
| WO | 2009111053 | | 9/2009 | |
| WO | 2011092236 | | 8/2011 | |

OTHER PUBLICATIONS

Nakanishi et al., "Properties of chemical bath deposited CdS thin films," Solar Energy Materials and Solar Cells 35, 1994, pp. 171-178.

Kim et al., "Physical properties of CdS thin films grown by chemical bath deposition with directly immersed ultrasonication module," Thin Solid Films 519, 2011, pp. 1787-1793.

Ichiboshi et al., "Ultrasonic chemical bath deposition of Zns(O,OH) buffer layers and its application to CIGS thin-film solar cells," Solar Energy Materials and Solar Cells 90, 2006, pp. 3130-3135.

Kushiya et al., "Yield issues on the fabrication of 30 cm×30 cm-sized Cu(In,Ga)Se2-based thin-film modules," Solar Energy Materials and Solar Cells 75, 2003, pp. 171-178.

Kushiya et al., "Application of Zn-Compound Buffer Layer for Polycrystalline CuInSe2-Based Thin-Film Solar Cells," Jpn. J. Appl. Phys. 35, 1996, pp. 4383-4388.

Choi et al., "Properties of Cadmium Sulfide Thin Films Deposited by Chemical Bath Deposition With Ultrasonication," Solar Energy vol. 64, Nos. 1-3, 1998, pp. 41-47.

Eitssayeam et al., "Properties of CdS:Ni films prepared by chemical bath deposition method," Journal of Materials Science 40, 2005, pp. 3803-3807.

"Office Action of China Counterpart Application", issued on Mar. 17, 2015, p. 1-p. 9.

"Office Action of Europe Counterpart Application", issued on Nov. 13, 2015, p. 1-p. 22.

* cited by examiner

CHEMICAL BATH DEPOSITION (CBD) APPARATUS

CROSS-REFERENCE TO RELATED APPLICATION

This application claims the priority benefit of Taiwan application serial no. 100146215, filed on Dec. 14, 2011. The entirety of the above-mentioned patent application is hereby incorporated by reference herein and made a part of this specification.

BACKGROUND

1. Technical Field

The disclosure relates to a liquid phase deposition apparatus, and particularly to a chemical bath deposition (CBD) apparatus.

2. Related Art

CBD is a liquid phase deposition process widely used in many industries at present. The most common CBD is conducted in a chemical tank. However, the volume of the chemical tank is quite large, and thus large amount of chemical plating solution must be used, leading to a decreased solution utilization, which not only causes a high deposition cost, but also incurs a major problem of wastewater treatment. Another CBD is to locate a substrate to be deposited in a crucible with a surface facing upward, and then pour a solution into the crucible to cover the substrate to be deposited, so as to perform the deposition. However, in the deposition process, the plating solution is also deposited on the crucible, which not only lowers the plating solution utilization, but also increases the process time because the crucible is required to be cleaned after deposition. For example, for the fabrication cost of a $Cu(InGa)Se_2$ (CIGS) solar cell, a buffer layer plays a very important role. In case that a CdS buffer layer with a thickness of 50 nm is fabricated through a traditional CBD, the cost thereof accounts for 20% (excluding a substrate) of the cost of the cell, and thus the fabrication cost of the cell can be greatly lowered if the disadvantage can be effectively alleviated. In addition, in the traditional CBD, accompanying the cluster-cluster growth mechanism, ions in the solution form solid particles in the solution first, and then are adhered to the solid substrate, so that the formed film is opaque, uneven, and poor in adhesion. Therefore, if nucleated particles on the substrate can be removed effectively, the cell efficiency can be effectively improved.

SUMMARY

A CBD apparatus is introduced herein, by which the process can be simplified, the energy can be saved, the volume of wastewater can be reduced, the film quality can be improved, and the apparatus cost can be lowered.

The disclosure provides a CBD apparatus, which includes a first cap, a second cap, and a solution input/output device. The second cap is arranged corresponding to the first cap so as to form a deposition space. The solution input/output device is disposed in the first cap, so as to feed a solution into/out of the deposition space. The position of the solution input/output device is fixed, or the solution input/output device is movable in the deposition space.

Several exemplary embodiments accompanied with figures are described in detail below to further describe the disclosure in details.

BRIEF DESCRIPTION OF THE DRAWINGS

The accompanying drawings are included to provide further understanding, and are incorporated in and constitute a part of this specification. The drawings illustrate exemplary embodiments and, together with the description, serve to explain the principles of the disclosure.

DETAILED DESCRIPTION OF DISCLOSED EMBODIMENTS

Figure 1:
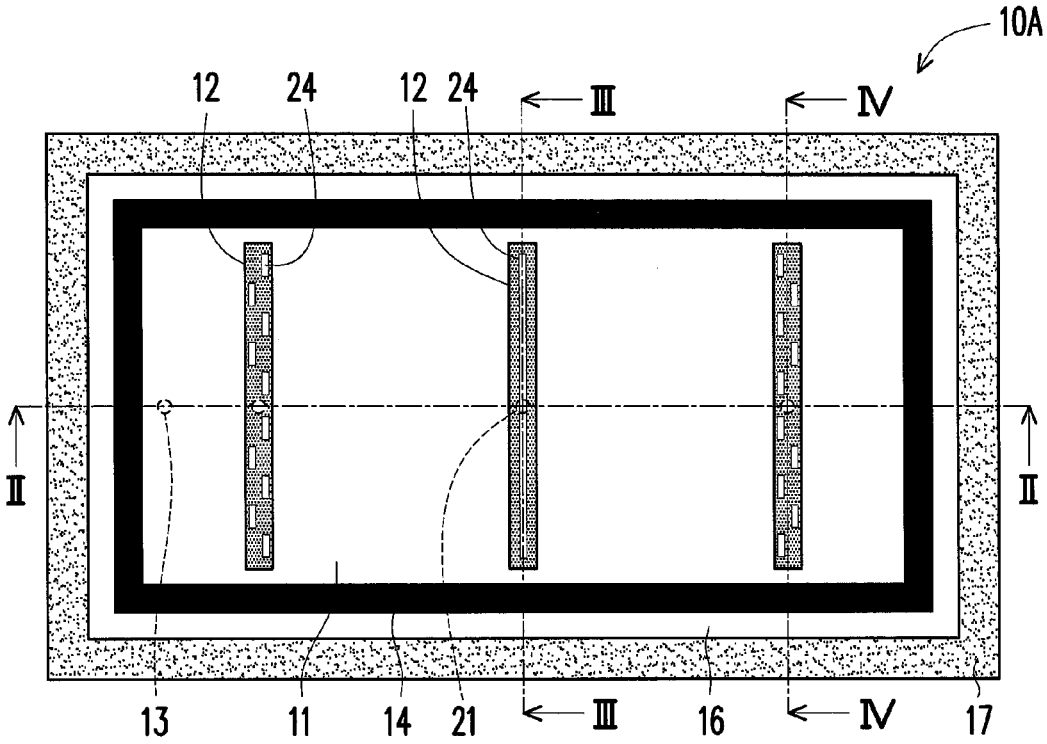
FIG. 1 is a top view illustrating a CBD apparatus according to an exemplary embodiment of the disclosure.

For simplicity, in the embodiments below, the same elements are represented by the same numerals. In addition, sizes or shapes of the elements in the drawings are exemplary, and are not entirely scaled according to actual sizes or shapes of the elements.

Figure 2:
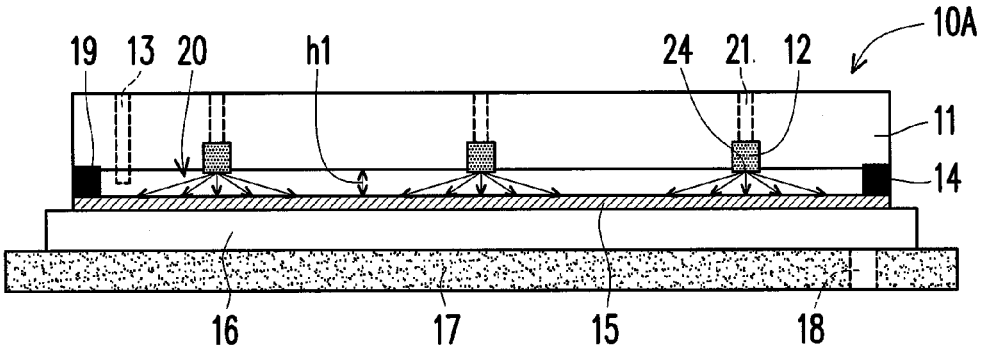
FIG. 2 is a schematic cross-sectional diagram along a cut line II-II shown in FIG. 1.

Referring to FIG. 1 and FIG. 2, a CBD apparatus 10A includes a first cap 11, a second cap 15, and a solution input/output device 12.

The second cap 15 is arranged corresponding to the first cap 11, to form a deposition space 20. The first cap 11 can avoid the change in composition of a plating solution caused by escape of a volatile material in the plating solution, so as to maintain the quality of a deposited film. In an embodiment, a material of the first cap 11 may include a high heat-preservation material, a corrosion resistant material, and those having low surface energy or all of the above properties. The first cap 11 may be a substrate made of an inorganic material, a conductive material, a polymer, or a composite material. The inorganic material is, for example, glass, quartz, ceramic, or alumina. The conductive material includes a metal or an alloy, for example, aluminum alloy, titanium, or molybdenum. The polymer is, for example, polyvinyl chloride (PVC), polytetrafluoroethylene (PTFE), or polypropylene (PP). It should be noted that PTFE is acid and alkaline resistant, and has a low surface energy, and particles in the solution are difficult to nucleate thereon, so that the first cap 11 is made of PTFE, and a surface thereof can be easily cleaned after a deposited film is formed.

In addition, the first cap 11 may further provide a downward pressure on the second cap 15, by which the influence caused by a plating solution effluent in the deposition process to the quality of a deposited film can be effectively avoided. A weight of the first cap 11 is, for example, but not limited to, about 2 kg or higher.

The second cap 15 is a substrate to be deposited, and has a function of loading the plating solution. The second cap 15 may be substrate made of an inorganic material, a conductive material, semiconductive material, a polymer, or a composite material. The inorganic material is, for example, glass, quartz, or ceramic. The conductive material includes a metal, for example, an aluminum alloy, titanium, molybdenum, or stainless steel. The semiconductive material is, for example, silicon, CIGS, cadmium telluride, or other semiconductive materials having photoelectric conversion function. The polymer is, for example, polyimide (PI) or PTFE. In another embodiment, referring to FIG. 6, another substrate 22 to be deposited may be further arranged on the first cap 11.

Further referring to FIG. 1 and FIG. 2, in an embodiment, the CBD apparatus 10A of the disclosure further has a spacer 14, which has a sealing function. The spacer 14 is located at an edge of the first cap 11 and the second cap 15, and the edge of either or both of the first cap 11 and the second cap 15 are engraved with a groove 19, so that the spacer 14 can be inserted in the first cap 11 or the second cap 15. In the embodiments shown in FIG. 1 to FIG. 4, the spacer 14 can provide a distance between the first cap 11 and the second cap 15, so as to form a space for accommodating the plating solution required by CBD. The distance provided between the first cap 11 and the second cap 15 by the spacer 14 is, for example, 5 mm to 70 mm; however, the disclosure is not limited thereto, and the distance can be adjusted according to an actual thickness of the substrate to be deposited. In an embodiment, the spacer 14 can provide a distance between the first cap 11 and the second cap 15. The spacer 14 is required to have the properties of elasticity, acid and alkaline resistance, and low surface energy. The spacer 14 is, for example, an O-ring. A material of the O-ring is, for example, rubber, silicone, or PTFE. The size of the O-ring is that a perimeter is, for example, 100 mm, and a thickness is, for example, 2 mm. The groove 19 may be of a round shape, a square shape, or any other shape, and the shape of the groove 19 can be controlled to form a correspondingly different appearance of a deposited film.

Figure 6:
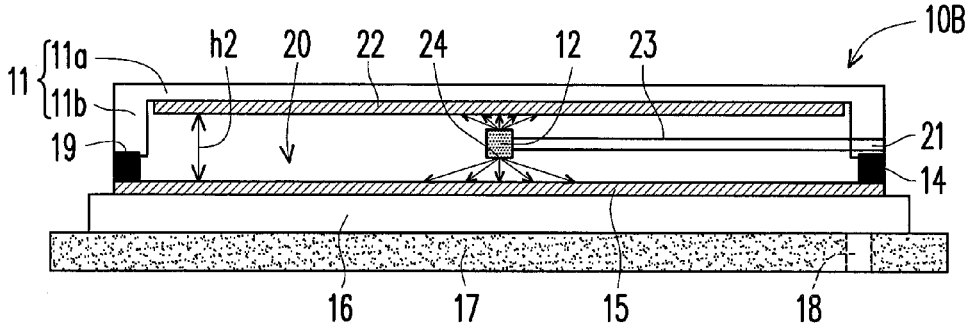
FIG. 6 is a schematic cross-sectional diagram along a cut line VI-VI shown in FIG. 5.
Figure 7:
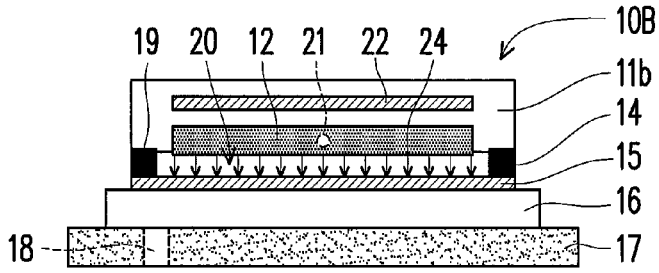
FIG. 7 and FIG. 8 are schematic cross-sectional diagrams along a cut line VII-VII shown in FIG. 5.
Figure 8:
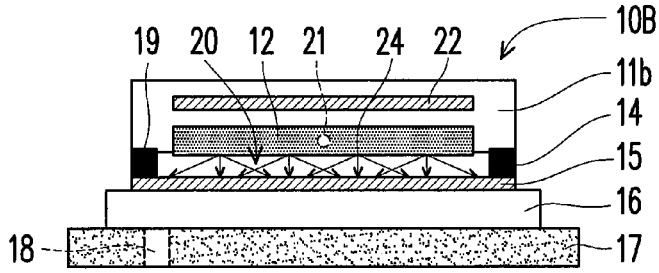
Figure 9:
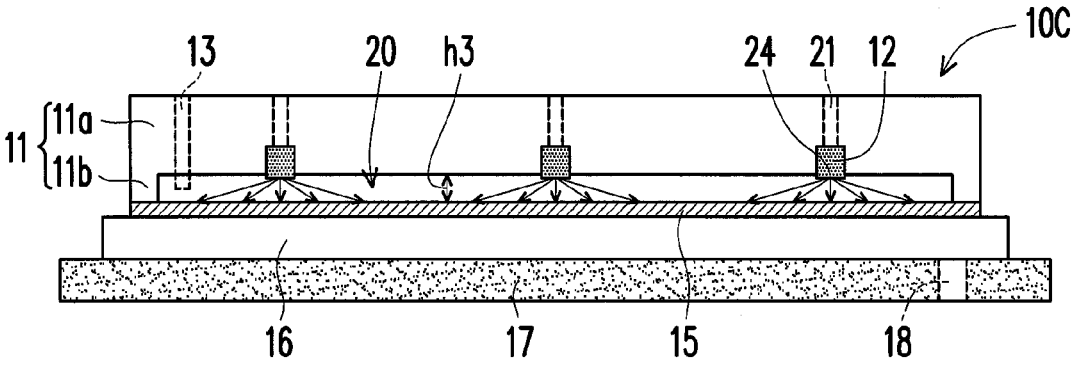
FIG. 9 is a cross-sectional diagram illustrating another CBD apparatus according to an exemplary embodiment of the disclosure.

In the embodiments shown in FIG. 1 to FIG. 4, a height h1 of the deposition space 20 required for accommodating the plating solution by CBD is provided by the spacer 14; however, the disclosure is not limited thereto, and the height of the deposition space 20 may also be provided by changing the design of the first cap 11 or the second cap 15. For example, referring to FIG. 6 to FIG. 8 and FIG. 9, the first cap 11 of a CBD apparatus 10B and 10C includes a body portion 11*a* and an extension portion 11*b*. In FIG. 6 to FIG. 8, the extension portion 11*b* of the first cap 11 extends downward from the body portion 11*a*, and provides, together with the spacer 14, a height h2 of the deposition space 20. In FIG. 9, a height h3 of the deposition space 20 is provided by the extension portion 11*b* of the first cap 11.

The height h1, h2, or h3 of the deposition space 20 is, for example, 5 mm to 70 mm; however, the disclosure is not limited thereto, and the height can be adjusted according to practical requirement.

Referring to FIG. 1 to FIG. 8, the solution input/output device 12 is disposed in the first cap 11. The position of the solution input/output device 12 may be fixed (as shown in FIG. 1 to FIG. 4), or the solution input/output device 12 is movable in the deposition space 20 (as shown in FIG. 5 to FIG. 8).

Figure 5:
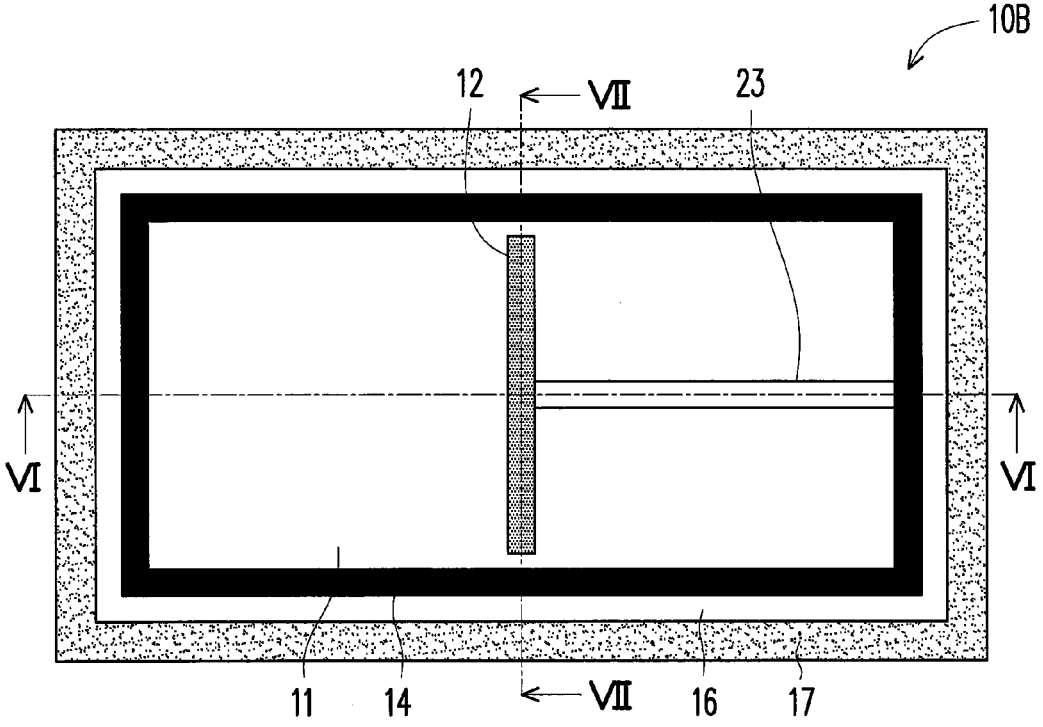
FIG. 5 is a top view illustrating another CBD apparatus according to an exemplary embodiment of the disclosure.

Referring to FIGS. 5 to 6, the solution input/output device 12 includes an arm 23 able to perform stretching motion and a solution injection chamber 26. The solution input/output device 12 is disposed on the extension portion 11*b* of the first cap 11 by the arm 23. The arm 23 has a solution pipe 25 therein, which can supply a fluid to the solution input/output device 12, and by the stretching of the movable arm 23, the solution input/output device 12 can move in the deposition space 20.

Moreover, as the solution input/output device 12 is disposed on the extension portion 11*b* of the first cap 11, if an adequate distance exists between the body portion 11*a* of the first cap 11 and the solution input/output device 12, another substrate 22 to be deposited may be disposed on the body portion 11*a* of the first cap 11, so that the substrate to be deposited, that is, the second cap 15, and the another substrate to be deposited on the body portion 11*a* of the first cap 11 are deposited simultaneously by full filling the deposition space 20 with the plating solution.

The solution input/output device 12 can provide a wetting solution, a plating solution, or a cleaning solution to the deposition space 20. The wetting solution is passed through the solution input/output device 12 to wet a surface of the substrate before the plating solution is introduced, so as to achieve the purpose of avoiding a decreased deposition coverage caused by the generation of micro-bubbles in subsequent injection of the plating solution, and the wetting action may be wetting the surface of the substrate first with a mist spayed by a mist nozzle. The cleaning solution can be used to remove impurities, for example, a KCN solution is used to remove CuSe series of compounds in a CIGS absorption layer, or solutions such as bromine in water may also be used to etch the substrate or remove a defect. In addition, the solution input/output device 12 may further have an ultrasonic vibration cleaning effect.

In addition to the substrate cleaning effect, the solution input/output device 12 further provide a route for solution input/output, pressure balancing, and gas input/output. Moreover, after the surface of the substrate is cleaned, air, argon, or nitrogen may be introduced in the deposition space by the solution input/output device 12, to remove moisture on the surface of the substrate to be deposited.

A material of the solution input/output device 12 includes Teflon, a metal, or a combination thereof, for example, aluminum, or stainless steel coated with Teflon.

Figure 5A:
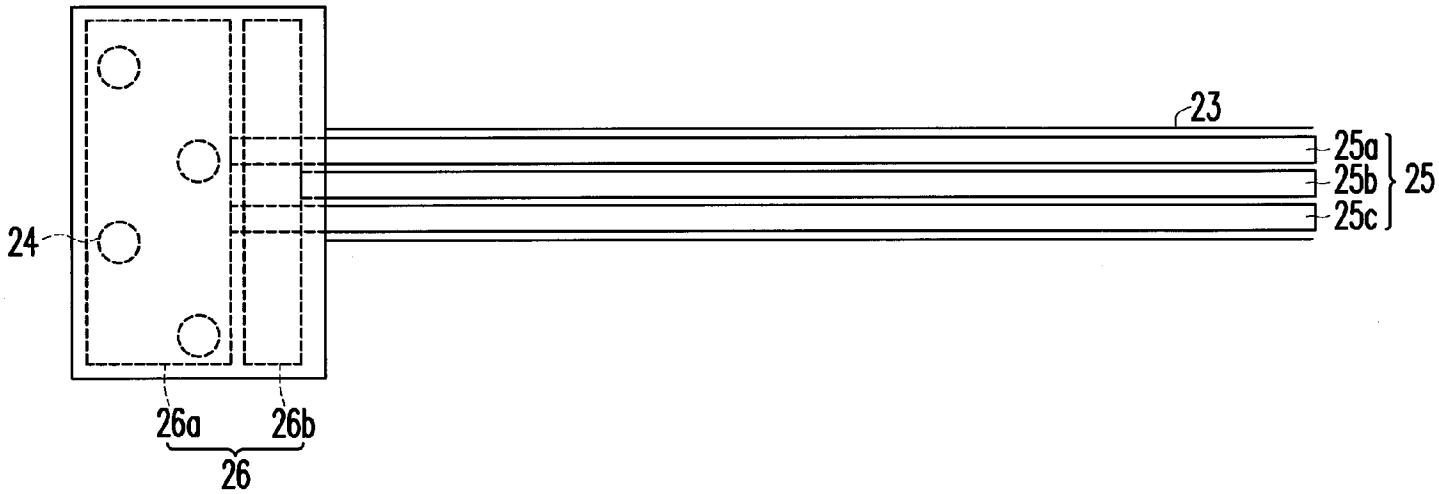
FIG. 5A is a top view illustrating a solution input/output device shown in FIG. 5.
Figure 5B:
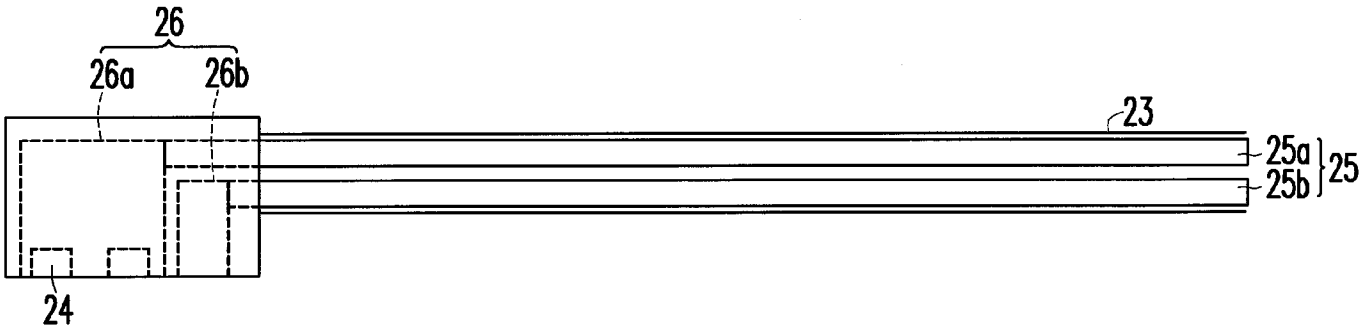
FIG. 5B is a cross-sectional diagram illustrating the solution input/output device shown in FIG. 5.
Figure 9A:
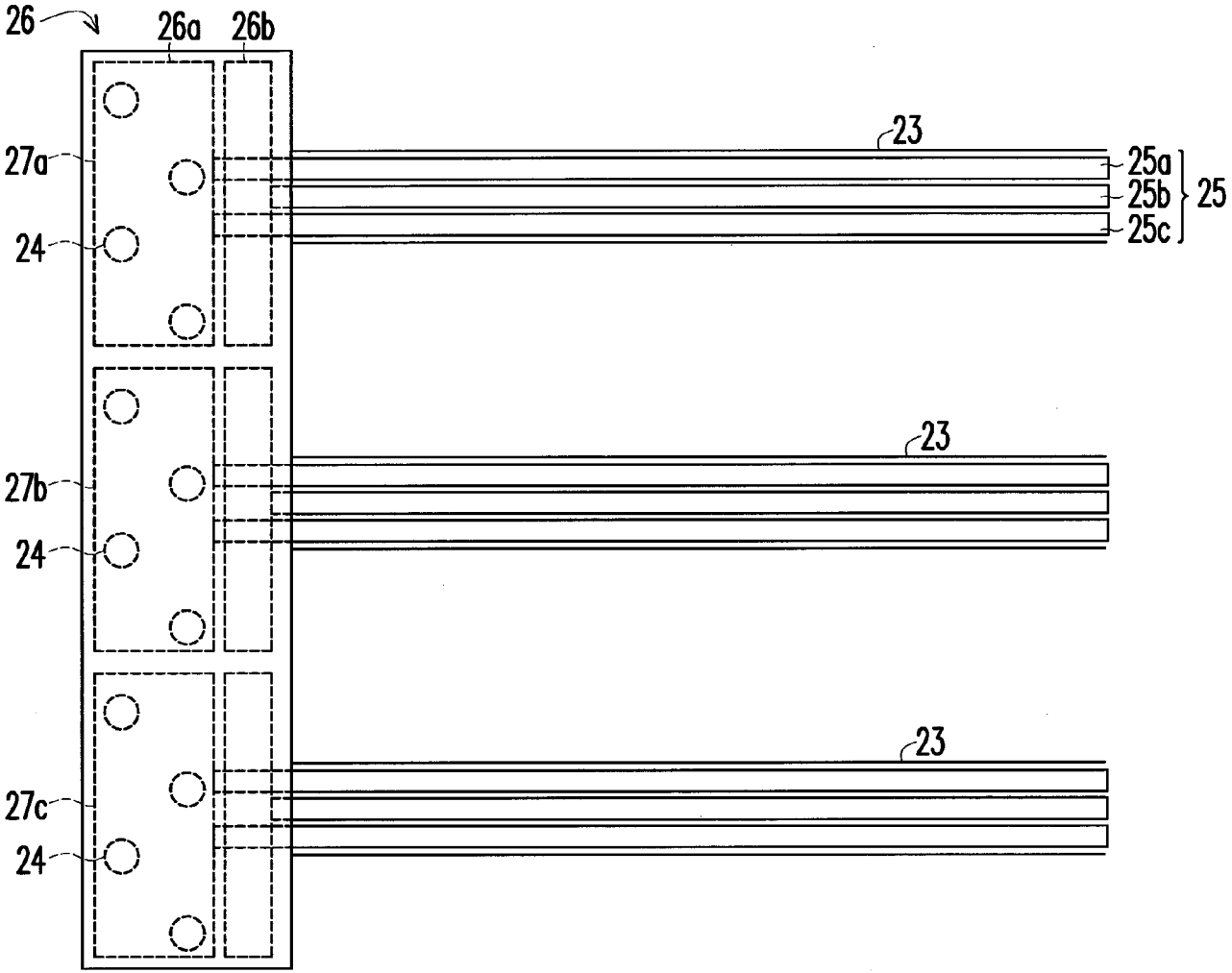
FIG. 9A is a top view illustrating a solution input/output device shown in FIG. 9.

FIG. 5A is a top view illustrating a solution input/output device according to an exemplary embodiment of the disclosure. FIG. 5B is a cross-sectional diagram illustrating the solution input/output device shown in FIG. 5A. FIG. 9A is a top view illustrating a solution input/output device shown in FIG. 9.

Referring to FIGS. 5, 5A, and 5B, the solution pipe 25 disposed in the arm 23 of the solution input/output device 12 may be a single pipe or multiple pipes. If the solution pipe 25 is a single pipe, deionized water, a chemical reaction solution, or a gas may be supplied at different periods of time, that is, different solutions or gases flow in the same pipe. If the solution pipe 25 is multiple pipes, in an embodiment, as shown in FIG. 5A and FIG. 5B, the solution pipe 25 includes, for example, a pipe 25*a*, a pipe 25*b*, and a pipe 25*c*. The pipe 25*a*, the pipe 25*b*, and the pipe 25*c* may be respectively used to supply DI water, a chemical reaction solution, and a gas, so that different solutions or gases flow in different pipes. However, the liquids or gases supplied by the solution pipe 25 are not limited thereto. In addition to, a pipe may be further added in the arm 23, which is connected to a pump, for discharging a waste liquid.

Figure 3:
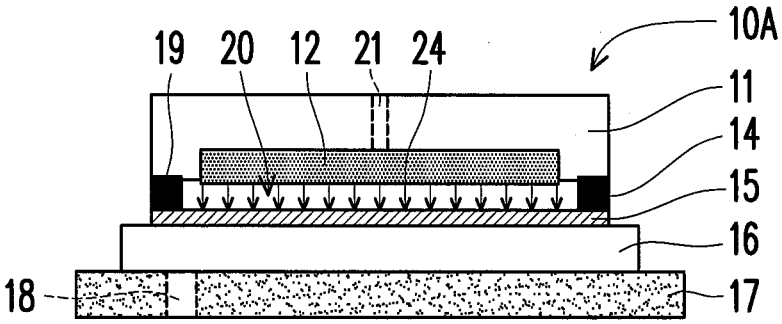
FIG. 3 is a schematic cross-sectional diagram along a cut line shown in FIG. 1.
Figure 4:
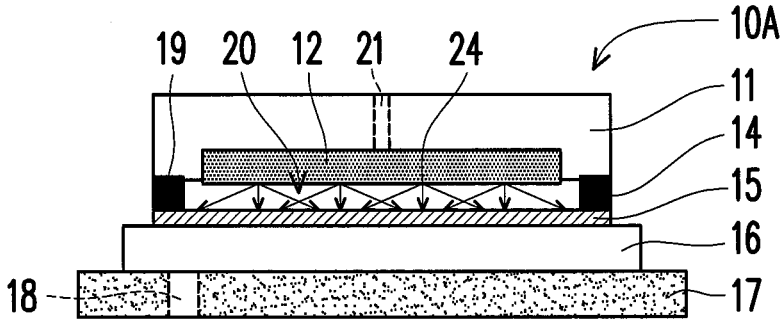
FIG. 4 is a schematic cross-sectional diagram along a cut line IV-IV shown in FIG. 1.

Furthermore, referring to FIGS. 5, 5A, and 5B, the solution injection chamber 26 may have a single compartment, or is divided into two or more compartments according to practical requirement. In an embodiment, the solution injection chamber 26 may be divided into a first compartment 26*a* and a second compartment 26*b*, in which the first compartment 26*a* may accommodate the chemical solution supplied by the pipe 25*b*, so as to provide a route through which the chemical solution enters the deposition space 20. The second compartment 26*b* may accommodate or hold DI water supplied by the pipe 25*a* and the gas supplied by the pipe 25*c*, and has an inlet/outlet 24 through which DI water and the gas enter the deposition space 20. The outlet/inlet 24 may be an inserted nozzle. Each compartment of the solution injection chamber 26 may have a single outlet/inlet 24 (as shown at a center of FIG. 1) or multiple outlets/inlets 24 (as shown at two sides of FIG. 1). For the single outlet/inlet 24, the problem of pressure drop needs to be considered when a largely sized substrate is cleaned. The problem of pressure imbalance can be alleviated in case that multiple outlets/inlets 24 exist. The outlet/inlet 24 may be disposed at any position in the solution input/output device 12. In FIG. 3, the outlet/inlet 24 is located at a bottom of the solution input/output device 12; however, the disclosure is not limited thereto. In FIG. 6, the solution input/output device 12 may spray the solution at any angle. The solution input/output device 12 can make the sprayed solution in a form of a mist, a film, or a pillar. For example, the solution input/output device 12 may make the sprayed solution in a form of a vertical flow (as shown in FIG. 3 or 7) or an inclined flow (as shown in FIG. 4 or 8). The vertical flow is to vertically provide (jet) a solution to the substrate. The inclined flow can provide the solution to the whole deposition space 20, so as to expand a workable range of the apparatus. The inclined flow includes different spray forms, for example, a cross flow and an annular flow. The cross flow can avoid the disadvantage of poor removal of homogenous nucleation caused when two flows from different directions are simultaneously sprayed on the substrate.

In an embodiment, the pipe 25*a* is used to supply deionized water, the air pipe 25*c* is used to supply air, and the pipe 25*a* and the pipe 25*c* may be connected to an external pump, so as to adjust the pressure of deionized water and gas supplied via the outlet/inlet 24, thereby achieving a cleaning purpose.

In addition, referring to FIGS. 9, and 9A, if the solution input/output device 12 has a large size, the solution input/output device 12 may be connected to the extension portion 11*b* of the first cap 11 by a single arm 23 or multiple arms 23. In the solution input/output device 12 shown in FIG. 9A, multiple arms 23 exist; however, the disclosure is not limited thereto. Likewise, a single pipe or multiple pipes may be disposed in each arm 23. In the figure, each arm 23 has a pipe 25*a*, a pipe 25*b*, and a pipe 25*c*; however, the disclosure is not limited thereto. The solution injection chamber 26 may be divided into multiple regions according to practical requirement. In an embodiment, the solution injection chamber 26 may be divided into a first region 27*a*, a second region 27*b*, and a third region 27*c*. The first region 27*a*, the second region 27*b*, and the third region 27*c* respectively have a first compartment 26*a* and a second compartment 26*b*. Details may be made reference to the description above and are not further described herein again. Through the disposition of multiple pipes, the problem of pressure drop caused by a too long pipe can be solved.

Referring to FIG. 1 to FIG. 8, materials are supplied into the solution input/output device 12 through a feeding inlet 21 in the first cap 11, and then the solution input/output device 12 provides the wetting solution, the plating solution, or the cleaning solution to the deposition space 20. The feeding inlet 21 may be of a round shape, a square shape, a rectangle shape, or any other shape. A diameter of a round feeding inlet is, for example, about 3-5 mm. The size of the feeding inlet 21 is suitably not excessively large, so as to avoid the influence caused by the evaporation of the plating solution to the quality of a deposited film. During feeding, the feeding inlet 21 is opened to balance to pressure, which can facilitate the injection of the solution. The feeding inlet 21 may be located at any position in the solution input/output device.

The CBD apparatus 10A, 10B, or 10C may further include a mixing device 16, which is disposed below the second cap 15. The mixing device 16 may include a heating unit and a shaking unit, for providing a heat source and mixing the solution. The heating unit can provide the heat source required in deposition, which may be a common heater, for example, resistance heating or infrared heating is employed. The heating unit may also be a material able to provide a heat source, for example, a material such as stainless steel or a copper block having a high thermal conductivity is immersed in a hot liquid, and then removed and used as a heat source after the temperature is stable. The heating unit in the mixing device 16 can be adjusted in a deposition process, so as to control a deposition rate. The deposition rate is generally proportional to the temperature; however, an excessively high temperature can result in massive homogeneous nucleation, which deteriorates the quality of a deposited film, and thus the deposition temperature is generally controlled to be in the range of 40-90° C., for example, about 70° C.

Furthermore, besides that the temperature can be controlled by the heating unit in the mixing device 16 in the CBD apparatus 10A, 10B, or 10C, when the material of the second cap 15 is conductive material such as stainless steel or titanium plate, a voltage can be directly applied to the second cap 15 by using the conductive property thereof, and then the level of the applied voltage is controlled, to achieve the purpose of controlling the temperature of the solution in the deposition space 20.

In addition, if the mixing device 16 is made of a magnetic material, a magnet may be positioned in the first cap 11. When the first cap 11 is positioned above the mixing device 16, a magnetic force of the first cap 11 attracts the lower mixing device 16, so as to provide a pressure, thereby enhancing the tightness between the first cap 11 and the second cap 15, and avoiding the problem of leakage of the solution.

The CBD apparatus 10A, 10B, or 10C may further include a tilt device 17, or further include a tilt stand 18. The tilt stand 18 can tilts the tilt device 17, and maintains the tilt device at a specific angle. The tilt device 17 is disposed below the second cap 15, for tilting the CBD apparatus 10A, 10B, or 10C, so as to pool the solution in the deposition space 20, and especially discharge the remaining plating solution, cleaning solution, or wetting solution via the feeding inlet 21 in the first cap 11 after a deposited film is formed.

More particularly, referring to FIG. 1 and FIG. 2, if the solution input/output device 12 is fixedly disposed at a position close to the edge of the first cap 11, when the solution in the deposition space 20 is pooled to the edge due to tilt, the feeding inlet 21 may further serve as a drainage hole of the waste liquid. The waste liquid and waste gas generated in the above process can be discharged through the outlet/inlet 24 of the solution input/output device 12 via the feeding inlet 21. If the solution input/output device 12 is fixedly disposed a position close to the center of the first cap 11, the first cap 11 may further include an opening 13 (as shown in FIG. 9), which is located at a position close to the edge of the first cap 11. When the solution in the deposition space 20 is pooled at the edge due to tilt, the opening 13 may be extended into the deposition space 20 through a pipe fitting, and used as a discharge route of the waste liquid. Referring to FIG. 5 and FIG. 6, if the solution input/output device 12 is movably disposed in the first cap 11, the solution input/output device 12 may move to a position close to the edge of the first cap 11, and the waste liquid and waste gas pooled at the edge due to tilt can be discharged through the outlet/inlet 24 of the solution input/output device 12 via the feeding inlet 21. The waste liquid discharged via the feeding inlet 21 or the opening 13 may be collected in a waste liquid barrel for recycle.

A method of using the CBD apparatus of the disclosure is described below with reference to an example in which a CdS film is deposited.

Deposition is carried out with a substrate to be deposited and having an area of about 100 $cm^2$, and 20 ml of a plating solution containing 0.0015 M cadmium sulfate, 1 M aqueous ammonia, and 0.0075 M thiourea, in which an average height of the solution is about 2 mm, and a deposition temperature is controlled to be 70° C.

Referring to FIG. 2, in deposition, the substrate to be deposited is positioned above the mixing device 16 first, and served as the second cap 15, on which the plating solution is loaded. In this experiment, glass is used as the second cap 15. The mixing device 16 uses a material (e.g. copper) having a high thermal conductivity as a heat source.

In the deposition process, after the second cap 15 is positioned above the mixing device 16, the first cap 11 and the spacer 14 are positioned on the second cap 15, and the spacer 14 is inserted in the first cap 11 by means of the groove 19 at the edge of the first cap 11. In this embodiment, the material of the first cap 11 is PTFE, which is acid and alkaline resistant and can be easily cleaned after deposition. An O-ring of perfluorinated rubber material is used as the spacer 14, and the size of the O-ring is that a perimeter is about 100 mm, and a thickness is about 2 mm. It is found through experiment that no degradation problem occurs even when the O-ring experiences 300 times of deposition.

Besides the above functions, the first cap 11 further provide a downward pressure on the second cap 15, by which the influence caused by a plating solution effluent in the deposition process to the quality of a deposited film can be effectively avoided. The weight of the first cap 11 in the experiment is about 2 kg, and in the presence of the downward pressure provided by the first cap 11, there is no concern about leakage of the plating solution in the deposition experiment.

After the first cap 11 and the spacer 14 are covered on the second cap 15, materials is fed through the feeding inlet 21, in which the diameter of the feeding inlet 21 is about 3-5 mm. Before deposition, the deposition space 20 may be first cleaned or wetted by the solution input/output device 12. In the deposition process, the mixing device 16 is adjusted to control the deposition speed. The deposition temperature is, for example, controlled to be in the range of 40-90° C., and the deposition temperature in the experiment is 70° C.

In the deposition process, deposition parameters may be controlled to obtain a specific film thickness. After deposition, the plating solution can be discharged by the solution input/output device 12 through the feeding inlet 21, or discharged via the opening 13. In discharge of the solution, a degree of tilt of the deposition apparatus can be controlled by the tilt stand 18 in the tilt device 17, to facilitate the discharge of the solution. The cleaning process has a significant effect on the quality of a deposited film, which can remove homogenously nucleated particles attached to a surface in the deposition process. The solution input/output device 12 may clean the surface when being fixedly disposed as shown in FIG. 1 and FIG. 2, or clean the surface when being movable disposed as shown in FIG. 5 and FIG. 6. A cleaning manner may be rinsing an outer surface of the substrate with a water, or cleaning the surface by ultrasonic vibration. In addition to the substrate cleaning effect, the solution input/output device 12 shown in FIG. 1 to FIG. 9 further provide a route for solution input/output, pressure balancing, and gas input/output. After the surface of the substrate is cleaned, air, argon, or nitrogen may be introduced in the deposition space 20 by the solution input/output device 12, to remove moisture on the surface of the substrate to be deposited. A waste liquid, and waste gas generated in the above process are discharged by the solution input/output device 12 and collected in a waste liquid barrel for recovery. The process time is 20 min, and a thickness of a film thus fabricated is about 80 nm.

Figure 10:
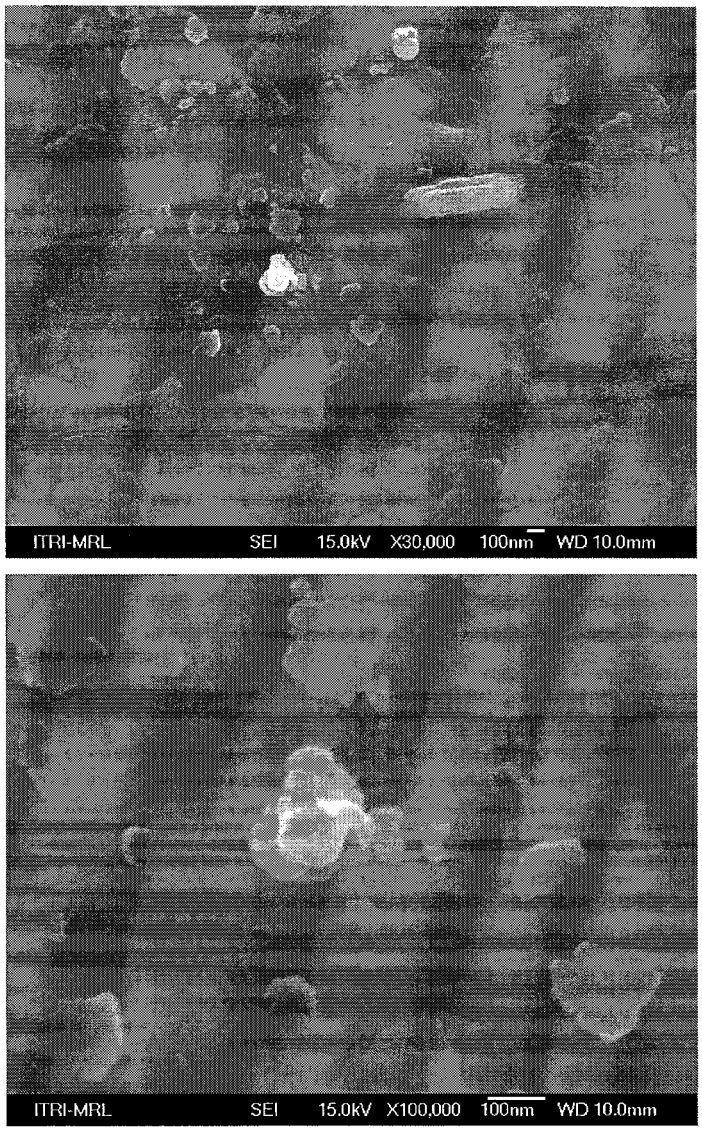
FIG. 10 is an electron microscope photograph of a deposited and uncleaned film.
Figure 11:
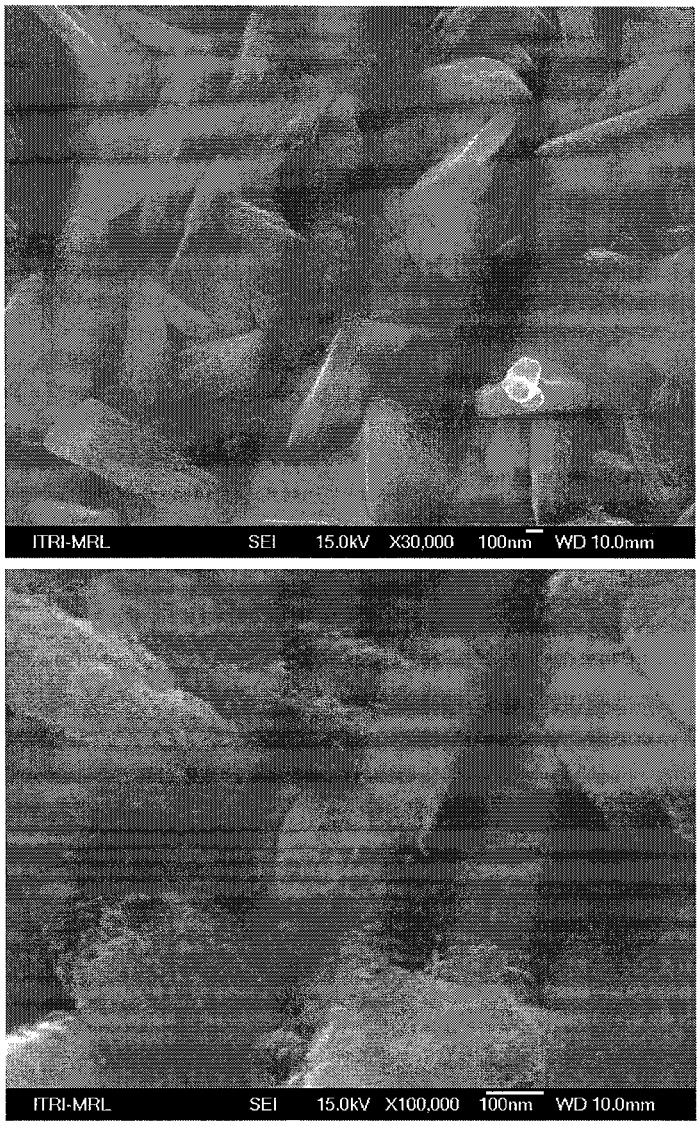
FIG. 11 is an electron microscope photograph of a film that is cleaned after being deposited by using a CBD apparatus according to an exemplary embodiment of the disclosure.

FIG. 10 is an electron microscope photograph of a deposited and uncleaned film. FIG. 11 is an electron microscope photograph of a film that is cleaned after being deposited by using a CBD apparatus according to an exemplary embodiment of the disclosure. It can be clearly seen from the photographs that after cleaning by using the CBD apparatus of the disclosure, impurities on the surface of the deposited film can be effectively removed.

Figure 12:
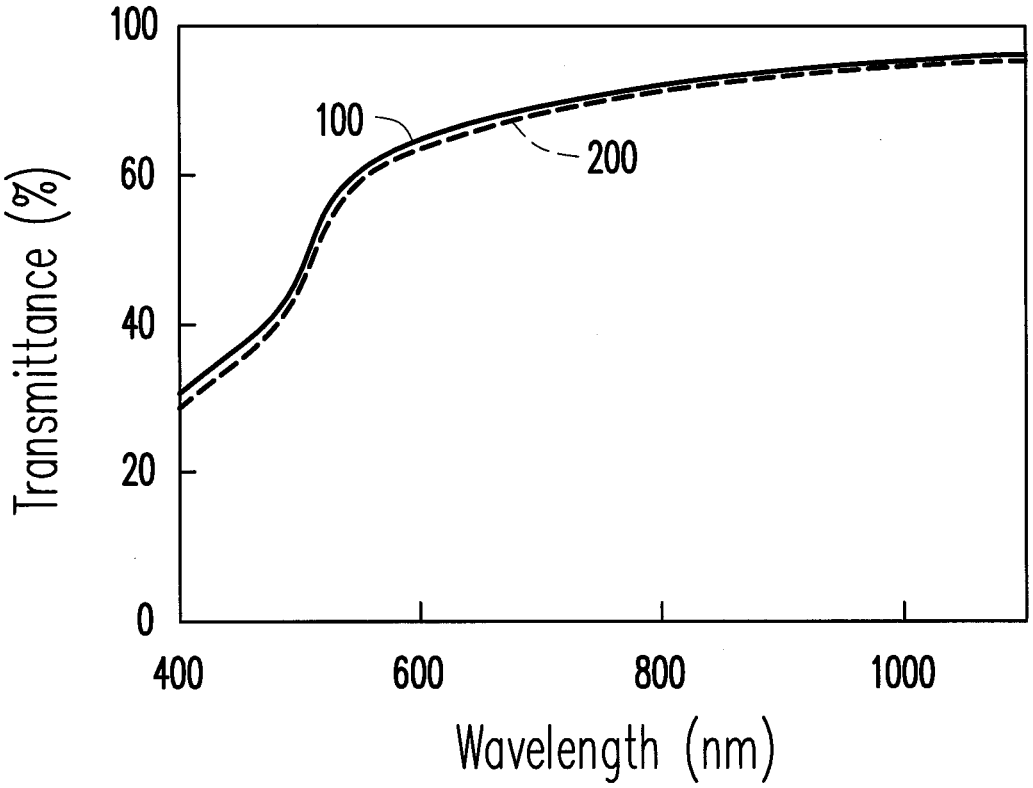
FIG. 12 illustrates transmittance of a deposited and uncleaned film and a film that is cleaned after being deposited by using an apparatus according to an exemplary embodiment of the disclosure.

FIG. 12 illustrates transmittance of a deposited and uncleaned film and a film that is cleaned after being deposited by using a CBD apparatus according to an exemplary embodiment of the disclosure. The results obtained from FIG. 12 shows that the transmittance represented by a curve 100 of the cleaned deposited film is obviously improved compared with that represented by a curve 200 of the uncleaned deposited film.

TABLE 1

| Cell | Open-circuit voltage Voc (V) | Short-circuit current density Jsc ($mA/cm^2$) | Fill factor F.F. (%) | Efficiency | Sheet resistance Rsh (Ohm) | Resistance Rs (Ohm) |
|---|---|---|---|---|---|---|
| Cell 1 | 0.00 | 0.000 | Inf | 0.009 | NaN | NaN |
| Cell 2 | 0.59 | 25.106 | 47 | 6.933 | 1659 | 61 |
| Cell 3 | 0.59 | 19.298 | 28 | 3.214 | 429 | 174 |
| Cell 4 | 0.00 | 0.000 | Inf | 0.042 | NaN | NaN |
| Cell 5 | 0.59 | 24.887 | 69 | 10.085 | 5674 | 24 |
| Cell 6 | 0.00 | 0.000 | Inf | 0.024 | NaN | NaN |

TABLE 2

| Cell | Open-circuit voltage Voc (V) | Short-circuit current density Jsc ($mA/cm^2$) | Fill factor F.F. (%) | Efficiency | Sheet resistance Rsh (Ohm) | Resistance Rs (Ohm) |
|---|---|---|---|---|---|---|
| Cell 1 | 0.56 | 24.957 | 52 | 7.309 | 550 | 34 |
| Cell 2 | 0.58 | 24.028 | 72 | 10.049 | 6378 | 23 |
| Cell 3 | 0.58 | 25.262 | 72 | 10.487 | 3992 | 22 |
| Cell 4 | 0.58 | 25.291 | 71 | 10.467 | 8748 | 22 |
| Cell 5 | 0.57 | 23.922 | 65 | 8.892 | 1597 | 26 |
| Cell 6 | 0.58 | 25.936 | 72 | 10.753 | 5447 | 22 |

Table 1 shows electrical performances of a film that is deposited through CBD and uncleaned. Table 2 shows electrical performances of a film that is cleaned after being deposited by using the CBD apparatus of the disclosure. The results of Table 1 and Table 2 show that the electrical performances of the cleaned deposited film are superior to those of the uncleaned deposited film.

To sum up, in the disclosure, the chemical bath process can be effectively improved and simplified through the special cap design. Because the deposition apparatus of the disclosure is simple, and a crucible is not needed to be used, the cost of crucible is saved, and the volume of waste liquid generated is reduced. Furthermore, in the disclosure, the quality of a chip after deposition can be greatly improved through the special chip cleaning design, so that the disclosure can be widely used in chemical bath deposition of a semiconductor compound film, for example, the fabrication of a buffer layer of a solar cell.

It will be apparent to those skilled in the art that various modifications and variations can be made to the structure of the disclosed embodiments without departing from the scope or spirit of the disclosure. In view of the foregoing, it is intended that the disclosure cover modifications and variations of this disclosure provided they fall within the scope of the following claims and their equivalents.

What is claimed is:

1. A chemical bath deposition (CBD) apparatus, comprising:

a first cap and a second cap, wherein the second cap is arranged corresponding to the first cap so as to form a deposition space, and an outer edge of the first cap has an extension portion, configured to provide a height of the deposition space; and a solution input/output device located in the first cap, wherein the solution input/output device is configured to move within the deposition space, and the solution input/output device comprises:

at least one aim, connected to the extension portion of the first cap, wherein the arm is configured to perform stretching motion;

at least one solution injection chamber, connecting the arm; and at least one solution pipe, located in the arm, wherein the solution pipe is configured to supply a fluid to the solution injection chamber.

2. The CBD apparatus according to claim 1, further comprising a mixing device, arranged below the second cap.

3. The CBD apparatus according to claim 2, wherein the mixing device comprises a shaking unit.

4. The CBD apparatus according to claim 2, wherein the mixing device comprises a heating unit.

5. The CBD apparatus according to claim 1, further comprising a spacer located at an edge of the first cap or an edge of the second cap, so that the deposition space is formed between the first cap and the second cap.

6. The CBD apparatus according to claim 5, wherein a material of the spacer comprises rubber, silicone, or polytetrafluoroethylene (PTFE).

7. The CBD apparatus according to claim 5, wherein the edge of the second cap or the first cap has a groove, and the spacer is arranged in the groove.

8. The CBD apparatus according to claim 7, wherein a shape of the groove comprises a round shape, a square shape, or an irregular shape.

9. The CBD apparatus according to claim 1, wherein the first cap further comprises a magnetic substance therein.

10. The CBD apparatus according to claim 1, wherein a material of the first cap comprises an aluminium alloy, glass, quartz, alumina, a polymer material, or a combination thereof.

11. The CBD apparatus according to claim 10, wherein the material of the first cap is a polymer, and the polymer material comprises polyvinyl chloride (PVC), PTFE, or polypropylene.

12. The CBD apparatus according to claim 1, wherein a material of the second cap comprises a glass substrate, a stainless steel substrate, or substrates of polyimide (PI) and varous semiconductive materials.

13. The CBD apparatus according to claim 1, wherein the second cap is a substrate to be deposited.

14. The CBD apparatus according to claim 1, wherein a substrate to be deposited is capable of being arranged on the first cap in the deposition space.

15. The CBD apparatus according to claim 1, wherein the solution input/output device is capable of making a sprayed solution in a foam of a mist, a film, or a pillar.

16. The CBD apparatus according to claim 1, wherein the solution input/output device is capable of spaying the solution in the deposition space at any angle.

17. The CBD apparatus according to claim 1, further comprising a tilt device, arranged below the second cap.

18. The CBD apparatus according to claim 1, wherein the solution injection chamber has at least one outlet/inlet.

19. The CBD apparatus according to claim 18, wherein the outlet/inlet comprises an embedded nozzle.

20. The CBD apparatus according to claim 18, wherein the outlet/inlet is located at any position in the solution input/output device.

* * * * *